US008721387B2

(12) United States Patent
Coleman et al.

(10) Patent No.: US 8,721,387 B2
(45) Date of Patent: May 13, 2014

(54) NOVELTY AND CONFECTION ROTATING DEVICE

(76) Inventors: Princess Ann Coleman, Franklin, TN (US); Thomas J. Coleman, Franklin, TN (US)

( * ) Notice: Subject to any disclaimer, the term of this patent is extended or adjusted under 35 U.S.C. 154(b) by 112 days.

(21) Appl. No.: 13/462,896

(22) Filed: May 3, 2012

(65) Prior Publication Data

US 2013/0152720 A1 Jun. 20, 2013

Related U.S. Application Data

(60) Provisional application No. 61/577,876, filed on Dec. 20, 2011.

(51) Int. Cl.
*A63H 1/00* (2006.01)

(52) U.S. Cl.
USPC ..... 446/236

(58) Field of Classification Search
USPC ..... 446/236
See application file for complete search history.

(56) References Cited

U.S. PATENT DOCUMENTS

| | | | | |
|---|---|---|---|---|
| 1,339,934 | A | 5/1920 | Lindstrom | |
| 2,302,166 | A * | 11/1942 | Anthony | 221/133 |
| 2,766,123 | A * | 10/1956 | Moubayed | 426/132 |
| 3,226,878 | A | 1/1966 | Glass et al. | |
| 3,810,561 | A * | 5/1974 | Merkl | 221/201 |
| 3,848,564 | A | 11/1974 | Kull | |
| 4,109,825 | A * | 8/1978 | Weitzman | 221/14 |
| 4,483,459 | A * | 11/1984 | Taylor et al. | 221/14 |
| 5,139,384 | A * | 8/1992 | Tuttobene | 414/281 |
| 5,209,692 | A * | 5/1993 | Coleman et al. | 446/71 |
| D351,901 | S | 10/1994 | Boruch et al. | |
| 5,498,134 | A | 3/1996 | Ibekwe | |
| 5,605,249 | A * | 2/1997 | Gonyea | 221/6 |
| 5,690,535 | A | 11/1997 | Coleman et al. | |
| 6,062,936 | A | 5/2000 | Rudell et al. | |
| 6,074,266 | A | 6/2000 | Zak | |
| 6,095,885 | A | 8/2000 | Coleman et al. | |
| 6,230,930 | B1 * | 5/2001 | Sorensen et al. | 221/131 |
| 6,286,716 | B2 * | 9/2001 | Izawa et al. | 221/197 |
| 6,325,242 | B1 * | 12/2001 | Izawa et al. | 221/197 |
| 6,328,180 | B1 * | 12/2001 | Sorensen et al. | 221/131 |
| 6,352,175 | B2 * | 3/2002 | Izawa et al. | 221/197 |
| 6,513,677 | B1 * | 2/2003 | Sorensen et al. | 221/130 |
| 6,645,030 | B2 | 11/2003 | Coleman et al. | |
| 6,955,524 | B2 | 10/2005 | Stengel | |
| D556,878 | S | 12/2007 | Radtke et al. | |
| 7,369,909 | B2 * | 5/2008 | Marshall | 700/98 |
| 7,566,048 | B1 | 7/2009 | Ptak | |
| 7,658,602 | B2 * | 2/2010 | Fornaguera | 425/235 |
| 7,771,182 | B2 * | 8/2010 | Fornaguera | 425/133.1 |
| 7,775,848 | B1 | 8/2010 | Auerbach | |
| 8,100,291 | B2 * | 1/2012 | Dikken | 221/120 |
| 2007/0172562 | A1 * | 7/2007 | Medina Quintanilla | 426/393 |

(Continued)

*Primary Examiner* — Kurt Fernstrom
*Assistant Examiner* — Dolores Collins
(74) *Attorney, Agent, or Firm* — Thomas & Karceski, P.C.

(57) ABSTRACT

A novelty and confection rotating device includes a main housing having an electric motor and a power supply. The electric motor drives a first drive shaft at a first rpm. A rotatable object is connected to this first drive shaft. A gear apparatus is then connected to the first drive shaft and to a second drive shaft. The gear apparatus reduces the rotational speed from the first rpm of the first shaft to a slower, second rpm of the second drive shaft. The difference between the first rpm and second rpm is substantial.

15 Claims, 6 Drawing Sheets

(56) References Cited

U.S. PATENT DOCUMENTS

2008/0153385 A1 6/2008 Coleman et al.
2012/0213894 A1* 8/2012 Block et al. ..... 426/104
2012/0318819 A1* 12/2012 Dikken ..... 221/113

* cited by examiner

NOVELTY AND CONFECTION ROTATING DEVICE

This application claims the benefit of U.S. Provisional Application No. 61/577,876, filed Dec. 20, 2011, which is incorporated by reference herein in its entirety.

The field of the invention is a novelty device that includes an electric motor that drives gears connected to multiple shafts for simultaneously rotating or moving a confection and novelty, specifically where the rotational speeds of the shafts may be substantially different.

BACKGROUND

There exist many types of devices that have rotating or spinning confections. Examples of these devices include both battery powered and wind up spring powered mechanisms. A limitation with existing devices is that the rotating or spinning mechanisms have a single speed or, in the case of more than one rotating or spinning object, have generally similar rotation speeds.

SUMMARY

It is an object of the present invention to provide a device for use in connection with rotating or spinning confections that includes a second spinning object that is simultaneously able to spin at a high speed. In this way, a user is able to enjoy a confection and enjoy the visual or physical benefit of a rapidly spinning object with the same device.

In one example, a novelty and confection rotating device comprises a main housing comprising an electric motor and a power supply. The electric motor is operatively connected to and rotates a first drive shaft at a first rpm. A first rotatable object is connected to the first drive shaft and is adapted to rotate at a high speed. A gear apparatus is connected to the first drive shaft into a second drive shaft, wherein the gear apparatus reduces the rotational speed from the first rpm to a slower, second rpm. The second drive shaft is connected to the gear apparatus and rotates at the second rpm. The second drive shaft comprises a holder for replaceably holding a confection. The first rpm is at least about twenty times greater than the second rpm. In another example, the first rpm is at least about a hundred times greater than the second rpm. The first rotatable object may be a fan. In another example, the first rotatable object may comprise a light or a plurality of lights. The first rotatable object may further comprise a battery, and the light is a light emitting diode. The first rpm may be about fifteen hundred or greater or, alternatively, about twenty-five hundred or greater. The second rpm may be about seventy or less, or alternatively about forty-five or less. The holder may be expandable and adapted to be compatible with multiple types of confections. The gear apparatus may include a worm gear/straight gear combination apparatus.

In a further example, the novelty and confection rotating device may further comprise a third drive shaft rotatably connected to the gear apparatus and that rotates at a third rpm. The first rpm is at least about twenty times greater than the third rpm. The third drive shaft may comprise a second holder for replaceably holding a confection. Alternatively, the third drive shaft may comprise a novelty object mounted thereon.

In a further, the first rotatable object may be a disc with light emitting diodes that rotates at a fast rpm and projects light up onto the character/object and/or onto the user's face. In this example, the fast rpms would produce a blur effect of the lights. In another example, the first rotatable object may be a fan with reflective blades or transparent blades in combination with leds/bulbs to give a unique effect.

In still another example, the first rotatable object may have a sound-producing feature that may be either manual or electrical. The sound-producing feature may produce a clicking sound, a whirling sound, a whistle sound, a siren sound or any other desired sound.

DETAILED DESCRIPTION

Different examples of devices that embody the present invention shall be discussed herein and are demonstrated in the attached Figures. Of course persons with skill in the art will be able to create devices that incorporate the features described herein, but in different combinations and having slightly different visual effects or slightly different structures. In any event, these devices demonstrate the use of a relatively high-speed rotating device in combination with a second, slower-speed rotating object. Typically, the second object is a confection, including but not limited to a lollipop, other hard candy, or popsicle or other frozen treat.

Figure 1:
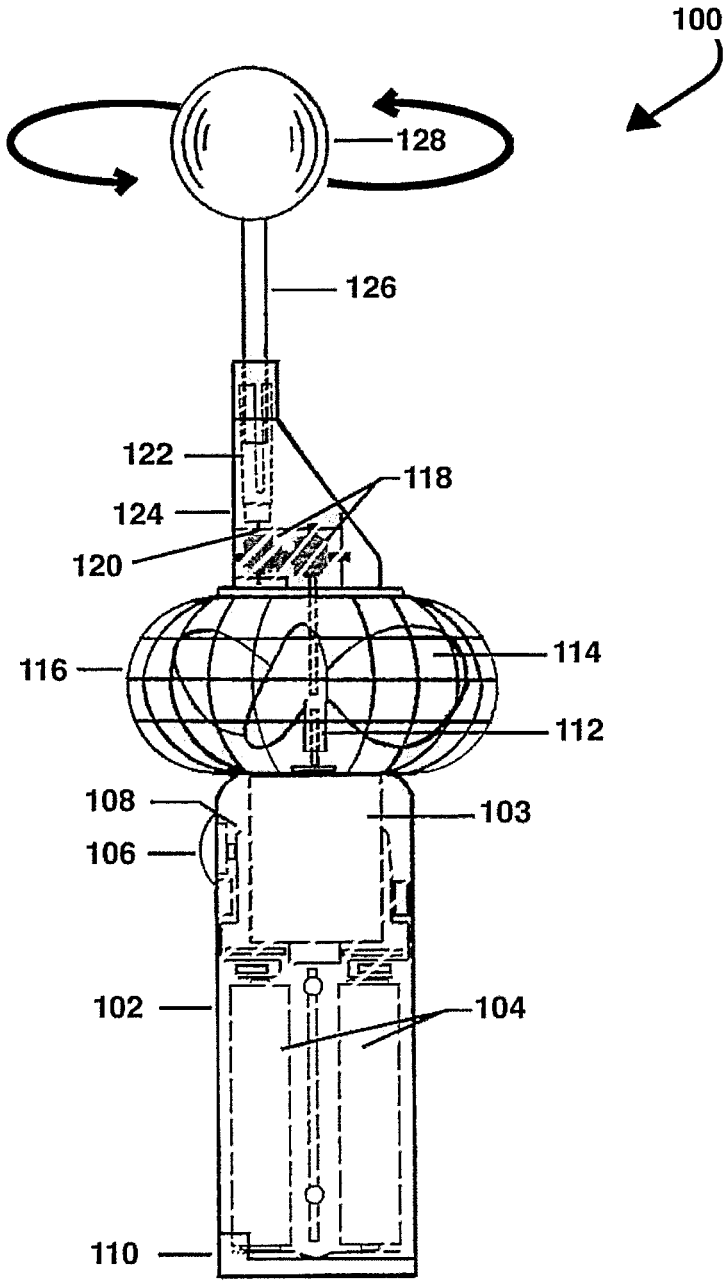
FIG. 1 is a side elevation view of an example of a device described in the present invention.

Turning first to FIG. 1, there is shown a rotating device 100 that includes a main housing 102. Within the main housing 102, is a power supply 104, a switch 108, a button 106 and a motor 103. A power supply door 110 is located on the outside of the main housing 102 for easy access to change the battery or batteries 104 that are the power supply of the motor 103. A secondary housing 116 is secured to the main housing 102. The secondary housing 116 has a rotatable object 114 which can be any suitable shape or size, in this example a fan, and a first drive shaft 112 and a second drive shaft 120. The upper housing 124 is secured to the secondary housing 116. In another example, an upper housing could be loosely attached to a secondary housing to allow movement of the upper housing. Inside the upper housing 124 is a worm gear/straight gear combo gearbox 118, and an expandable stick holder 122. In some examples, a worm gear/straight gear combo gearbox could be located in a secondary housing or a main housing. Extra gears, cogs or cams could be added to the inside or outside of a worm gear/straight gear combo gearbox to provide for a character(s) or object(s) that would move or rotate via the rotatable object(s) and secondary drive shaft. A candy 128 formed on a stick/nipple 126 is located at the upper end of the upper housing 124. The main, secondary and upper housings 102, 116 and 124 can be any desired shape or size.

A candy 128 and stick/nipple 126 is inserted into the expandable stick holder 122 of the upper housing 124. The expandable stick holder 122 adapts to most lollipop sticks that are on the market today. If a molded candy is preferred over the candy with a stick, the expandable stick holder could be replaced with a nipple to receive the molded candy. The expandable stick holder 122 is inside the upper housing 124 and is secured to the top of the worm gear/straight gear combo gearbox 118. The worm gear/straight gear combo gearbox 118 is secured to one end of the second drive shaft 120 in the upper housing 124. The first drive shaft 112, which is secured to the motor 103 in the main housing 102, partially extends into the lower end of a rotatable object 114 and also extends into the gearbox 118.

The power supply 104 provides power to the motor 103 in the main housing 102 when the switching means 108 is activated by pressing the button 106 on the outside of the main housing 102. The motor 103 engages the first drive shaft 112 and spins the rotatable object 114 at a desired speed in the secondary housing 116.

In one example, a DC motor running on 1.5 volts could spin a rotatable object at approximately 6000 rpms. With selected gearing, such as two spur gears, each with twelve teeth, and two worm gears, it could then reduce the rotation of the candy to approximately 25-30 rpms. Another example would be to use a DC motor running on 3 volts, which could then spin the rotatable object at approximately 7000 rpms, and using the same gearing arrangements of two spur gears, each with twelve teeth, and two worm gears, would then reduce the rpms to 40-45 rpms. The results of the rpms will vary depending on whether a standard battery/batteries or an alkaline battery/batteries are used. Other gear configurations can be used to produce the same speed reduction depending on the type and number of gears used. For character movement, it would be determined by the type of gear, cam and/or cog used to produce the desired movement. The speed of the character movement would depend on the reduced rpm output. Taking this action would have the rotatable object rotating at one speed and the expandable stick holder with candy spinning at a slower speed.

Other electric motors may be paired with different power sources to provide different rpm operation of the first and second drive shafts. The relatively high-speed first drive shaft may rotate at a speed of 1500 rpm or greater, or alternatively about 2500 rpm or greater. The second drive shaft may rotate at a speed of about 70 rpm or less, or alternatively about forty-five rpm or less. This means that the comparative speed of the first drive shaft and the first rpm is at least about twenty times greater than the second drive shaft and second rpm, or alternatively, the first rpm is at least about a hundred times greater than the second rpm.

Figure 2:
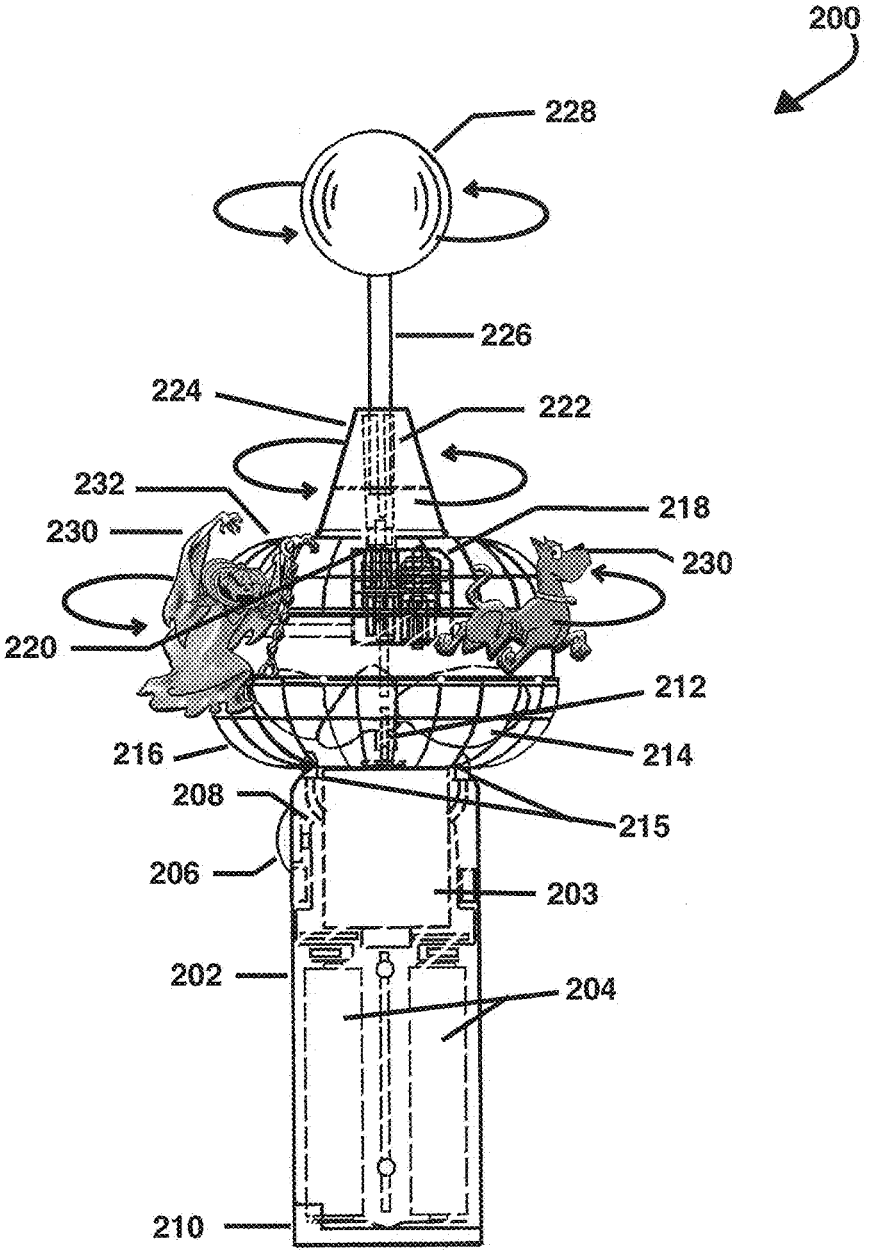
FIG. 2 is a side elevation view of an alternative embodiment of a device in accordance with the present invention.

Referring now to FIG. 2, an alternative example of a device 200 includes a main housing 202, a motor 203 and a power supply 204. The power supply door 210 provides access to inside the main housing 202 for the insertion of batteries or other power supplies. The main housing 202 further includes a button 206 and a switch 208 for activating the motor 203. The motor 203 drives a first drive shaft 212. The first drive shaft 212 is connected to rotatable object 214, in the example, a fan. The rotatable object 214 is protected by a housing 216. The first drive shaft 212 is connected to gearbox 218 which is connected to a second drive shaft 220. The second drive shaft 220 is connected to characters 230 and an upper cage 232. The characters 230 and upper cage 232 rotate with the rotation of the second drive shaft 220. The second drive shaft 220 is also connected to a stick holder 222 which has a stick/nipple 226 mounted therein. A hard candy 228 is molded onto the end of the stick/nipple 226. The candy 228 rotates at the same rpm as the second drive shaft 220.

The device 200 in FIG. 2 also includes stationary lights 215. These lights may be connected to a strobe controller. Alternatively, they can be activated and present interesting visual effects in combination with the fan 214. For instance, the fan 214 may be made of transparent plastic. Alternatively, the fan 214 could be made of mirrored or other reflective material to enhance the light effects coming from the lights 215.

Figure 3:
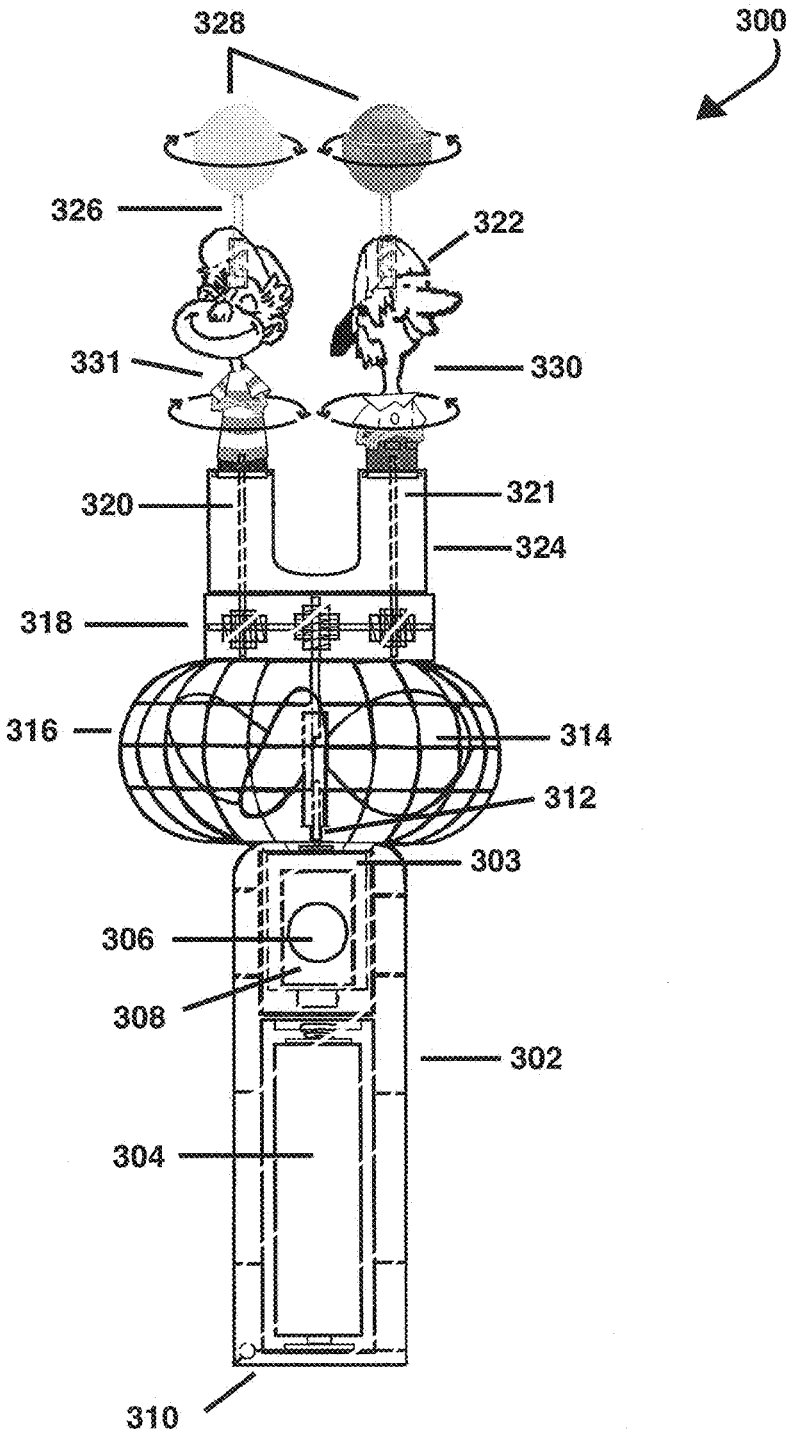
FIG. 3 is a side elevation view of a third embodiment of a device in accordance with the present invention.

Referring now to FIG. 3, a third example of a device 300 includes a main housing 302, motor 303, and power supply 304. A power supply door 310 is configured the main housing 302 to give access to the power supply 304 for easy replacement. A button 306 and switch 308 are the on and off actuators for the motor 303. The motor 303 drives the first drive shaft 312. The first drive shaft 312 is connected to the rotating object 314, in this example a fan, that is protected by a cage housing 316. The first drive shaft 312 is connected to a gearbox 318 that includes two output drive shafts 320 and 321. Each of these second and third drive shafts 320 and 321 is connected to a rotating character 330 and 331. Each of those rotating characters 330 and 331 comprise a stick/nipple holder 322. Mounted in those holders 322 are stick/nipples 326 and candy 328. The gearbox 318 may be tooled so that the second and third drive shafts 320 and 321 may rotate at the same or different rpms.

Figure 4:
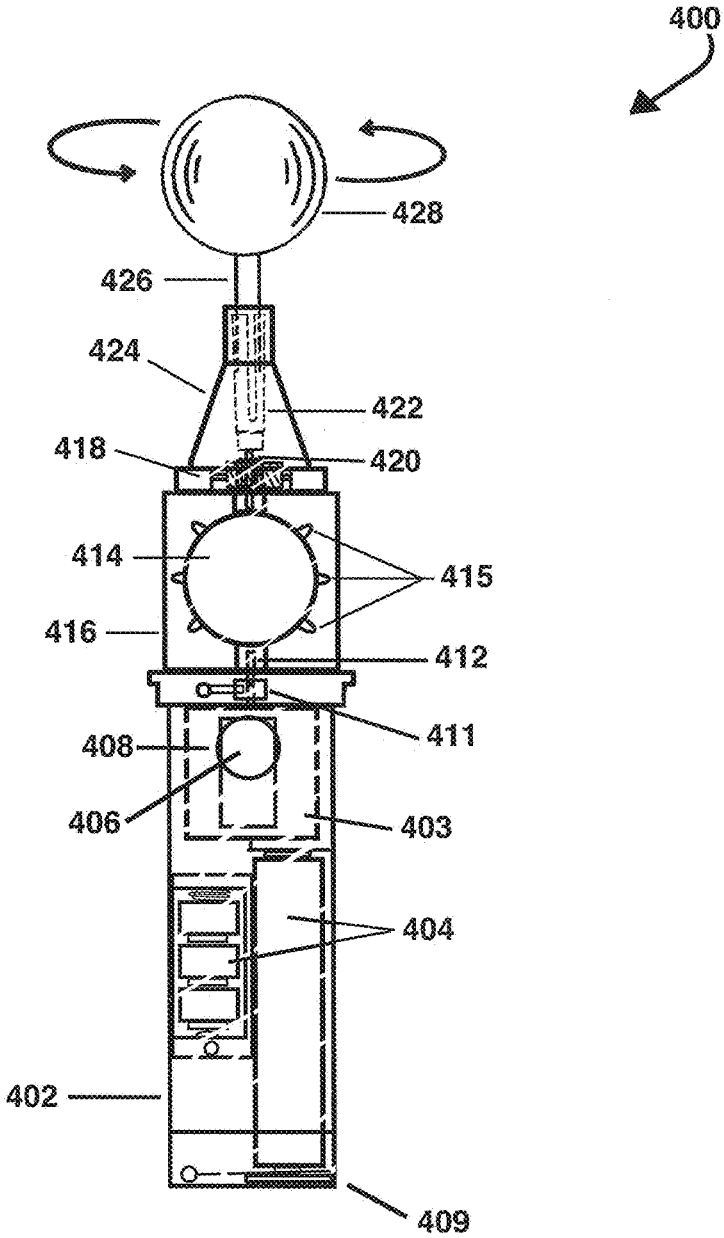
FIG. 4 is still a side elevation view of a fourth embodiment of a device in accordance with the present invention.

Referring now to FIG. 4, there is shown a rotating device 400 that includes a main housing 402, and motor 403, and power supply 404. In this example, the power supply 404 demonstrates two different types of batteries. Access to the power supply 404 is made through power supply door 409. A button 406 and switch 408 activate the motor 403. A first drive shaft 412 is connected to the motor 403. The first drive shaft 412 is also connected to rotatable object 414. The rotatable object 414 includes lights 415. A rotating contact 411 that is connected to the first drive shaft 412 allows for the power supply 404 to provide power to the lights 415. The rotatable object 414 is protected inside a secondary housing 416. The secondary housing may be substantially transparent, or alternatively, may include some printing or indicia for artistic or marketing effect. Gearbox 418 is connected to the first drive shaft 412 into a second drive shaft 420. The second drive shaft 420 is contained with the gearbox 418 inside upper housing 424. The second drive shaft 420 is connected to an expandable stick holder 422 which is connected with a stick/nipple 426 and a candy 428. In this example, the lights 415 are powered through use of the rotating contact 411 and the power supply 404. Alternatively, the lights 415 may be energized by a separate battery or power source that is mounted within the rotatable object 414.

Figure 5:
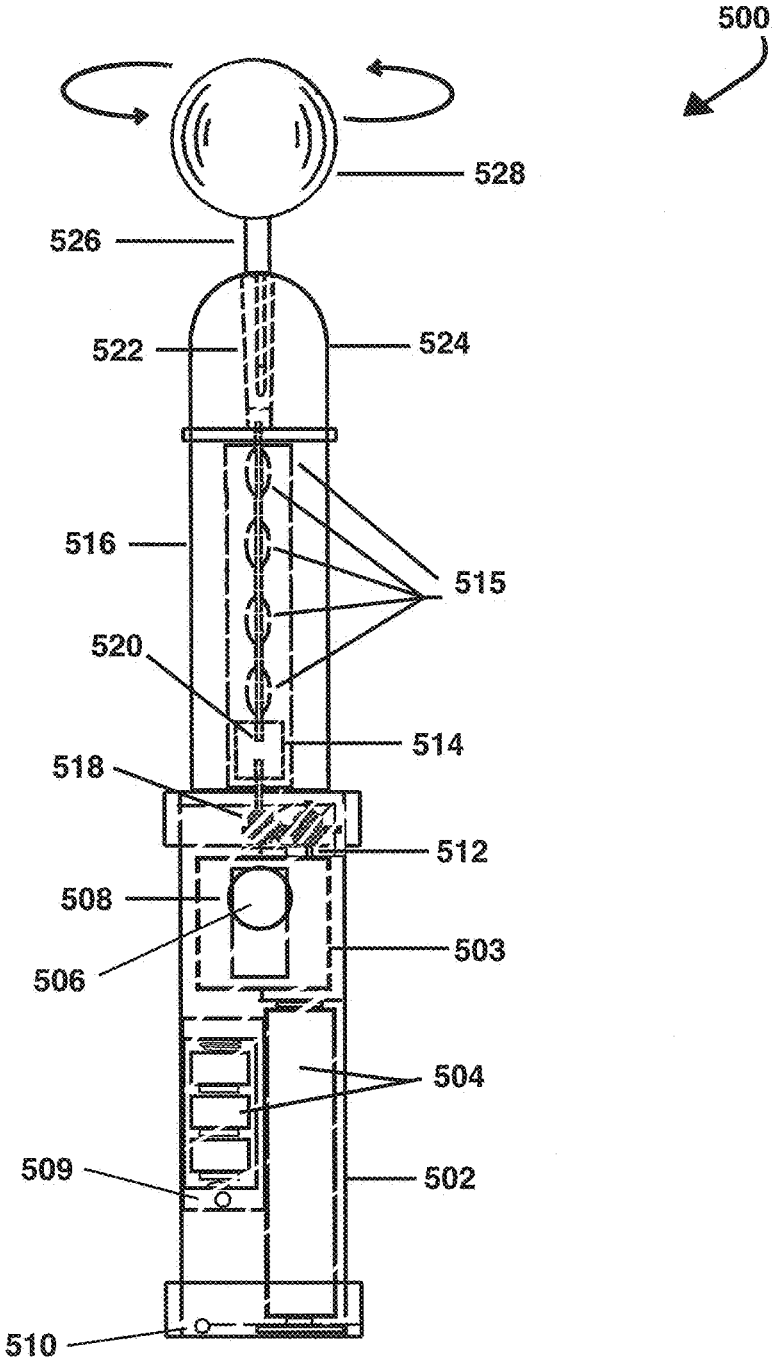
FIG. 5 is a side elevation view of a fifth embodiment of a device in accordance with the present invention.
Figure 6:
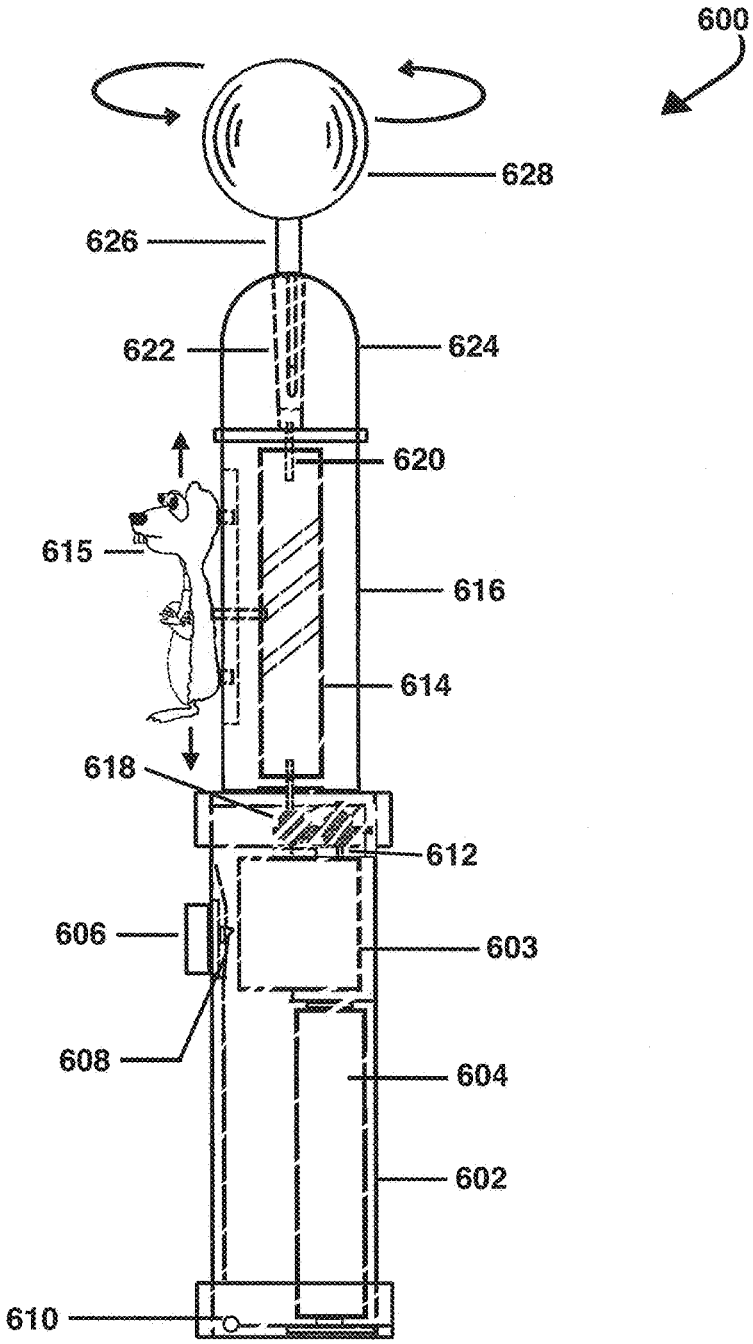
FIG. 6 is a side elevation view of a sixth embodiment of a device in accordance with the present invention.

FIGS. 5 and 6 are examples of devices where a rotatable object and a candy or confection rotate at the same speed/rpm. Referring to FIG. 5, the device 500 includes a main housing 502, motor 503 and power supply 504. The power supply 504 is shown having two different types of batteries. Those batteries are accessible through power supply doors 509 and 510. A button 506 and switch 508 activate the operation of the motor 503. A first drive shaft 512 is connected to a gear box 518 from which a second drive shaft 520 extends. The second drive shaft 520 is connected to rotatable object 514. The rotatable object 514 includes a plurality of lights 515. The rotatable object 514 is protected by a secondary housing 516 which is substantially transparent. The second drive shaft 520 is also connected to an expandable stick holder 524 that is contained within an upper housing 524. The holder 522 contains a stick/nipple 526 connected to a candy 528.

Referring now to FIG. 6, a device 600 includes a main housing 602 and motor 603. A power supply 604 is contained within the main housing and is accessible through power supply door 610. A button 606 and a switch 608 activate the motor 603. A first drive shaft 612 extends from the motor 603 into gearbox 618 the second drive shaft 620 extends from the gearbox 618 and is connected to rotatable object 614. A secondary housing 616 surrounds the rotatable object 614. In this example, the rotatable object 614 includes a cam that is connected to a character 615 for actuating up and down movement of the character 615. An upper housing 624 contains an expandable stick holder 622. A stick/nipple 626 is inserted in the stick holder 622 and carries a candy 628.

The specific examples discussed primarily herein relate to visual and physical effects such as the visual light show and the physical breeze from a fan. It is also possible that a novelty device could include an auditory feature. For instance, a clicker could be added to a rotating object to mechanically generate a sound. The rotating object may include certain shapes and geometries that create a whistle or a sound. Other sorts of sounds could be created by the rotating objects on the present device. These sound devices could be used together with one or more of the visual and physical features that have already been explained.

Other embodiments of the present invention will be apparent to those skilled in the art from consideration of the specification. It is intended that the specification and Figures be considered as exemplary only, with a true scope and spirit of the invention being indicated by the following claims.

The invention claimed is:

1. A novelty and confection rotating device comprising:

a main housing comprising an electric motor and a power supply, wherein the electric motor is operatively connected to and rotates a first drive shaft at a first rpm;

a first rotatable object connected to the first drive shaft, the first rotatable object adapted to rotate at a high speed;

a gear apparatus connected to the first drive shaft and to a second drive shaft, wherein the gear apparatus reduces the rotational speed from the first rpm to a slower, second rpm, and the second drive shaft is connected to the gear apparatus and rotates at the second rpm;

wherein the second drive shaft comprises a holder for replaceably holding a confection;

and further wherein the first rpm is at least about twenty times greater than the second rpm.

2. A novelty and confection rotating device as described in claim 1, further wherein the first rpm is at least about a hundred times greater than the second rpm.

3. A novelty and confection rotating device as described in claim 1, wherein the first rotatable object is a fan.

4. A novelty and confection rotating device as described in claim 1, wherein the first rotatable object comprises a light.

5. A novelty and confection rotating device as described in claim 4, wherein the first rotatable object comprises a plurality of lights.

6. A novelty and confection rotating device as described in claim 4, wherein the first rotatable object further comprises a battery, and the light is a light emitting diode.

7. A novelty and confection rotating device as described in claim 1, wherein the first rpm is about 1500 or greater.

8. A novelty and confection rotating device as described in claim 1, wherein the first rpm is about 2500 or greater.

9. A novelty and confection rotating device as described in claim 1, wherein the second rpm is about 70 or less.

10. A novelty and confection rotating device as described in claim 1, wherein the second rpm is about 45 or less.

11. A novelty and confection rotating device as described in claim 1, wherein the holder is expandable and adapted to be compatible with multiple types of confections.

12. A novelty and confection rotating device as described in claim 1, wherein the gear apparatus comprises a worm gear/straight gear combination apparatus.

13. A novelty and confection rotating device as described in claim 1, further comprising a third drive shaft rotatably connected to the gear apparatus and that rotates at a third rpm;

and further wherein the first rpm is at least about twenty times greater than the third rpm.

14. A novelty and confection rotating device as described in claim 13, wherein the third drive shaft comprises a second holder for replaceably holding a confection.

15. A novelty and confection rotating device as described in claim 13, wherein the third drive shaft comprises a novelty object mounted thereon.

* * * * *